US011633873B2

(12) United States Patent
Turcot

(10) Patent No.: US 11,633,873 B2
(45) Date of Patent: Apr. 25, 2023

(54) FINGER JOINT CUTTERHEAD WITH ADJUSTABLE INSERT KNIVES POSITIONING SYSTEM

(71) Applicant: GESTION D'ACTIFS GLADU INC., Marieville (CA)

(72) Inventor: Philippe Turcot, Marieville (CA)

(73) Assignee: GESTION D'ACTIFS GLADU INC., Marieville (CA)

( * ) Notice: Subject to any disclaimer, the term of this patent is extended or adjusted under 35 U.S.C. 154(b) by 147 days.

(21) Appl. No.: 17/345,022

(22) Filed: Jun. 11, 2021

(65) Prior Publication Data

US 2021/0387372 A1 Dec. 16, 2021

Related U.S. Application Data

(60) Provisional application No. 63/038,226, filed on Jun. 12, 2020.

(51) Int. Cl.
*B27G 13/14* (2006.01)
*B27F 1/16* (2006.01)

(52) U.S. Cl.
CPC ..... *B27G 13/14* (2013.01); *B27F 1/16* (2013.01)

(58) Field of Classification Search
CPC ..... B27G 13/02; B27G 13/04; B27G 13/08; B27G 13/10; B27G 13/12; B27G 13/14; B02C 18/18; B02C 18/182; B02C 18/184; B02C 18/186
See application file for complete search history.

(56) References Cited

U.S. PATENT DOCUMENTS

| | | | | |
|---|---|---|---|---|
| 6,327,951 | B1 * | 12/2001 | Feld | B27G 13/10 83/699.61 |
| 9,375,723 | B2 * | 6/2016 | Breja | B02C 18/186 |
| 10,814,412 | B1 * | 10/2020 | Smith | B27G 13/04 |
| 11,045,971 | B2 * | 6/2021 | Ehrle | B27G 13/12 |
| 11,065,780 | B2 * | 7/2021 | Turcot | B27F 1/04 |

* cited by examiner

*Primary Examiner* — Matthew Katcoff
(74) *Attorney, Agent, or Firm* — Norton Rose Fulbright Canada LLP

(57) ABSTRACT

A mechanism for adjusting the position of a knife on a rotary cutterhead mounted for rotation about a central axis comprises at least three dynamics positioning points for allowing a user to adjust the knife axially, radially and tangentially with respect to the central axis of the cutterhead.

20 Claims, 4 Drawing Sheets

FINGER JOINT CUTTERHEAD WITH ADJUSTABLE INSERT KNIVES POSITIONING SYSTEM

CROSS-REFERENCE TO RELATED APPLICATIONS

This application claims priority to U.S. provisional patent application No. 63/038,226 filed Jun. 12, 2020, the entire contents of which is incorporated by reference herein.

TECHNICAL FIELD

The application relates generally to cutting tools and, more particularly, to systems and methods for adjusting the position of finger joint knives on a rotary cutterhead.

BACKGROUND OF THE ART

Finger joint cutting is a known economical process to produce a long piece of wood from a number of short pieces of wood by providing matching surfaces at the ends of wooden pieces that can be fitted together and then subsequently glued.

Finger joint cutting machines typically comprise a rotating spindle on which a cutterhead is securely mounted. The cutterhead includes a body and a plurality of knife inserts distributed around a circumference of the body.

Conventional finger joint cutterhead knives are made of high speed steel (HSS) or brazed carbide tips. Both designs require the knives to be sharpened in their heads to ensure the proper runout. This is necessary to meet finger Joint quality requirements. Also, the vast majority HSS heads users install and sharpen the finger joint knives themselves in order to remain independent and to reduce downtime on the production chains.

There is a need for a system and method for adjusting the position of finger joint knives on a finger joint cutterhead.

SUMMARY

In one aspect, there is provided a mechanism for adjusting the position of a finger joint knife on a rotary cutterhead mounted for rotation about a central axis, the mechanism comprising: at least three dynamics positioning points for allowing a user to adjust the knife axially, radially and tangentially with respect to the central axis of the cutterhead.

In accordance with another aspect, there is provided a mechanism for adjusting the position of a finger joint knife in a pocket defined in a peripheral surface of a disc body of a rotary cutterhead mounted on a spindle for rotation about a central axis, the mechanism comprising: at least three dynamic knife supporting points adjustable relative to the disc body, the at least three dynamic knife supporting points including an adjustable axial referencing surface at one axial end of the pocket for axial abutment against an axial end surface of the finger joint knife, and a pair of adjustable radial referencing surfaces axially spaced apart along a radially inner bottom of the pocket for radial abutment against a radially inner end of the finger joint knife, the adjustable radial referencing surfaces being individually adjustable relative to one another to provide for an angular adjustment of the finger joint knife relative to the central axis.

In accordance with a further aspect, there is provided a rotary cutterhead comprising: a body mounted for rotation about a central axis, the body defining a pocket in a circumferentially extending peripheral surface thereof, the pocket having opposed front and back walls extending from a radially inner bottom surface, the front and back walls spaced-apart in a circumferential direction around the body and extending axially between a first axial face to a second axial face of the body; a knife insert mounted inside the pocket; a clamp for securely holding the knife insert against the back wall of the pocket; an axial adjustment screw mounted in a corresponding screw receiving hole defined in one of the first and second axial face of the body adjacent to the pocket, the axial adjustment screw having a head axially engageable with an axial end of the knife insert; and a pair of radial and tangential adjustment screws projecting radially outwardly from the radially inner bottom surface of the pocket for pushing against a radially inner end of the knife insert, the pair of radial and tangential adjustment screws axially spaced-apart along the pocket.

In accordance with a still further general aspect, there is provided a finger joint cutterhead comprising: a disc body having a peripheral surface extending circumferentially around a central axis; a pocket defined in the peripheral surface, the pocket having a front wall and a back wall spaced-apart in a circumferential direction and extending radially outwardly from a bottom wall and axially between opposed axial faces of the disc body; a finger joint knife clampingly mounted in the pocket; an axial knife reference surface adjustably mounted in an axial direction at one end of the pocket and configured for axial abutment with an adjacent axial end surface of the finger joint knife; and first and second radial knife reference surfaces axially spaced-apart along the bottom wall of the pocket, the first and second radial knife reference surfaces individually adjustable in a radial direction for radial abutment with a corresponding radially inner surface of the finger joint knife.

DESCRIPTION OF THE DRAWINGS

Reference is now made to the accompanying figures in which.

DETAILED DESCRIPTION

Figure 1:
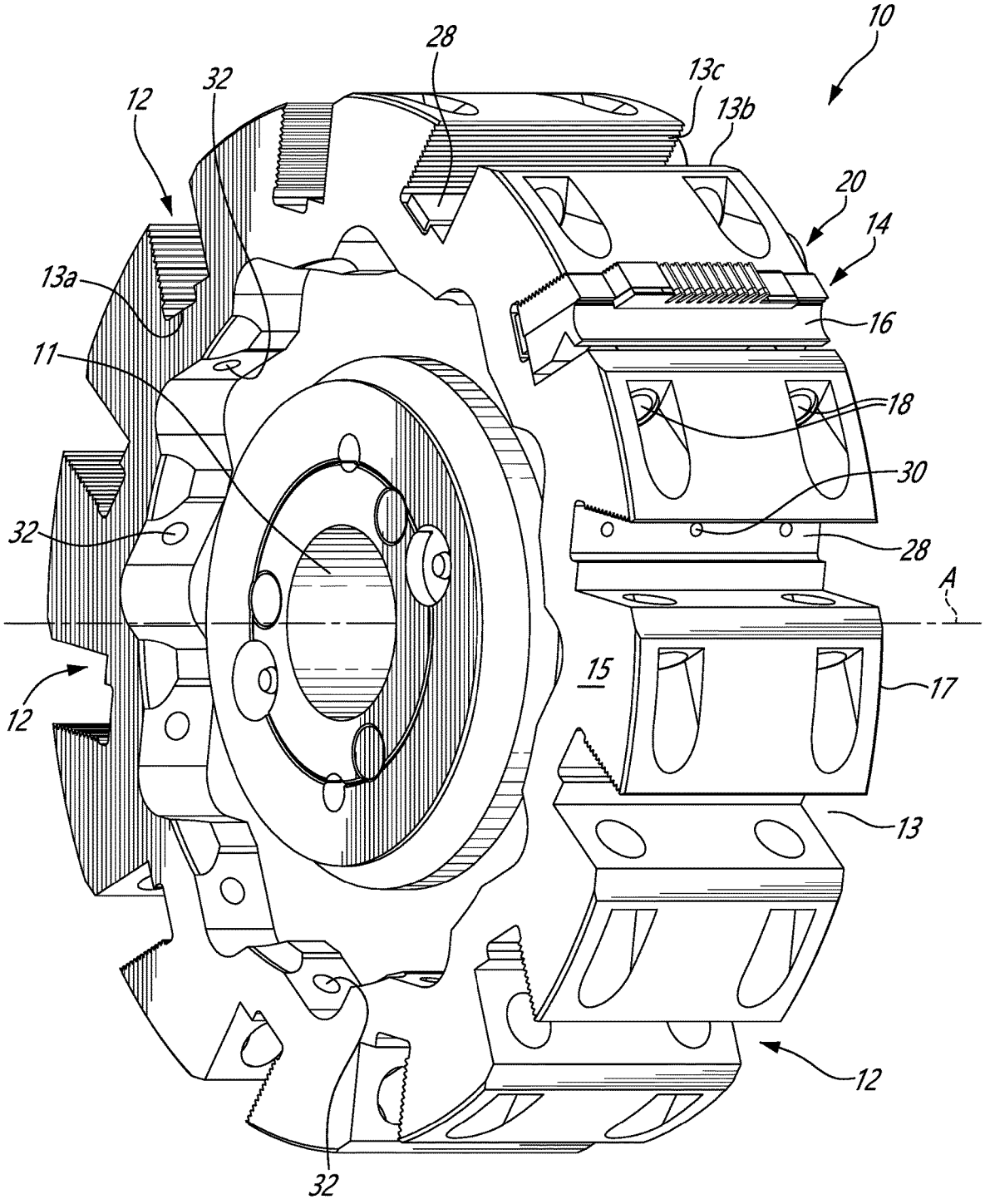
FIG. 1 is an isometric view of a finger joint cutterhead having an adjustable knife insert positioning system in accordance with one embodiment.
Figure 2:
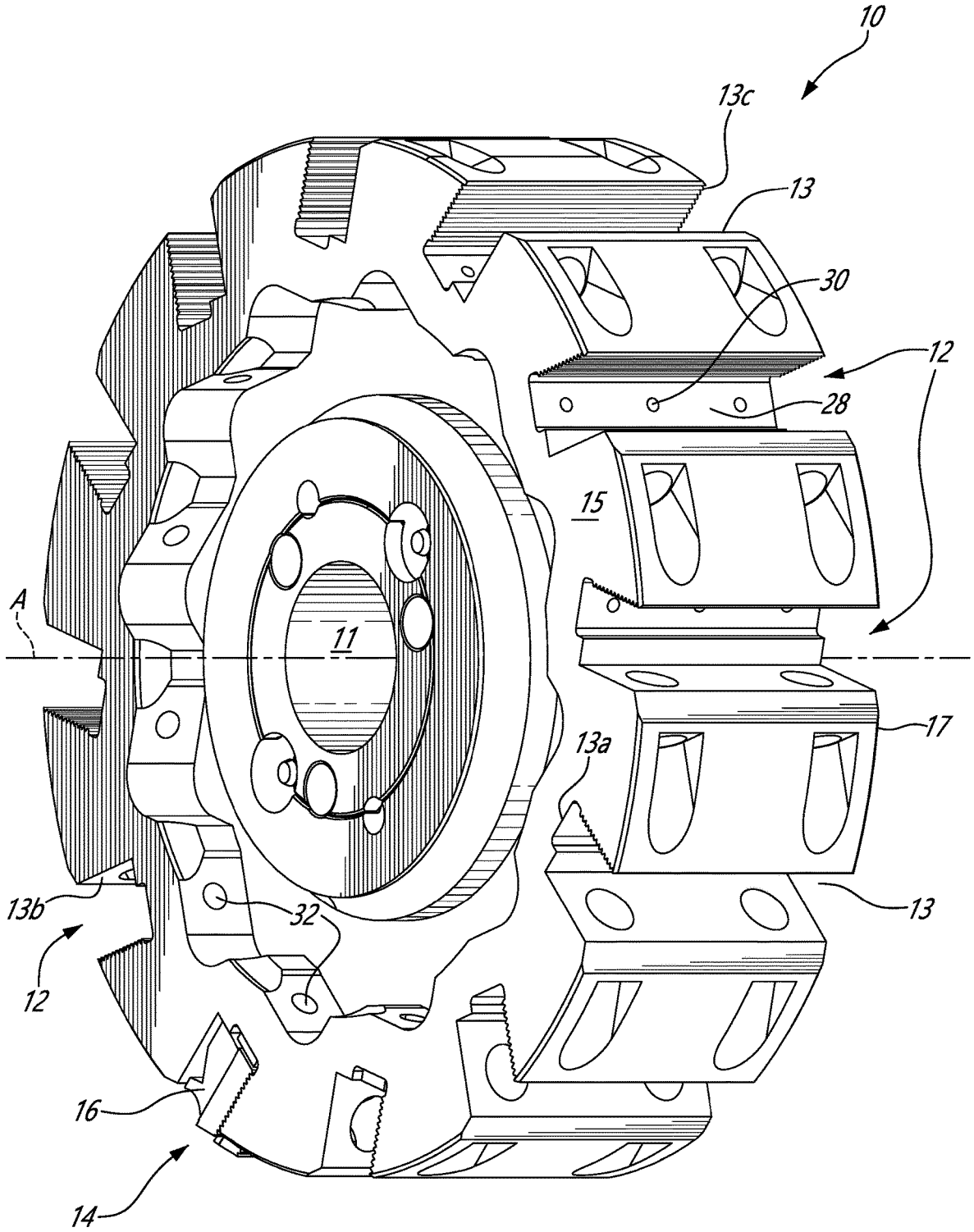
FIG. 2 is another isometric view of the finger joint cutterhead shown in a different angular position.

Referring to FIGS. 1 and 2, a finger joint cutterhead is generally shown at 10. The finger joint cutterhead 10 has a disc shaped body defining a central bore 11 that securely mounts to the spindle (not shown) of a rotary power drive (not shown) for rotation about a central axis A. A plurality of knife holders 12 are circumferentially distributed at regular intervals around a circumference of the body of the cutterhead 10. The knife holders 12 include recesses or pockets 13 integrally defined in the circumference of the body of the cutterhead 10 for receiving respective replaceable finger joint knife inserts 14 (only one shown in FIGS. 1 and 2). Each pocket 13 extends axially from a first axial face 15 of the body of the cutterhead 10 to a second opposed axial face 17 thereof. Each pocket 13 has a bottom wall 13*a*, a front wall 13*b* and a back wall 13*c*. According to the illustrated embodiment, the back wall 13*c* includes a radial array of axially extending serrations for cooperation with a corresponding radial array of axially extending serrations formed on the back face of the associated knife insert 14. The serrations are provided on certain embodiments as an additional safety feature to prevent unintentional dislodgement of the knife inserts 14 under centrifugal loading when the cutterhead 10 rotates at high speeds. Each knife holder 12 further comprises a clamping system for securely holding the knife inserts in position on the cutterhead 10. According to the illustrated embodiment, the clamping system comprises a wedge 16 and a pair of clamping screws 18. The clamping screws 18 are axially spaced-apart relative to axis A and threadably engaged in corresponding threaded holes defined in the body of the cutterhead 10 for pushing the wedge 16 firmly against the finger joint knife insert 14 and thus holding the back face of the knife insert 14 in firm contact against the serrated back wall 13*c* of the knife insert receiving pocket 13.

The finger knife inserts 14 may consist of diamond and/or carbide profiled inserts or other similar wear resistant material inserts offering long working life and high quality surface finish. According to one embodiment, the cutting edge of the knife inserts 14 comprises polycrystalline diamond. This substantially lengthens the life of the knives as compared to carbide or HSS knife inserts. Each knife insert 14 has a series of finger cutting teeth defined in a cutting edge thereof for finger jointing wood materials.

Figure 3:
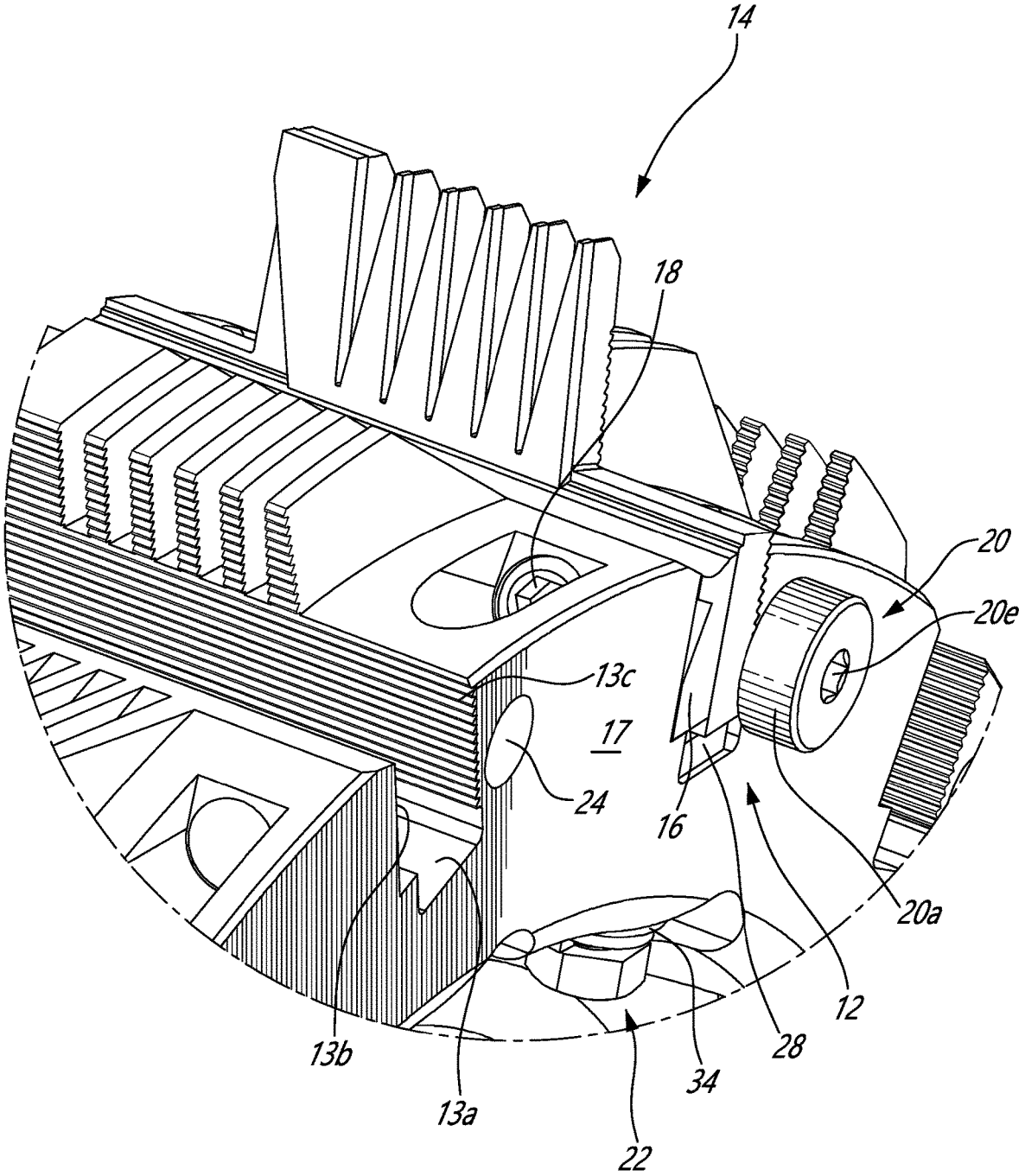
FIG. 3 is an enlarged isometric view of a portion of the finger joint cutterhead and illustrating details of the adjustable knife insert positioning system.
Figure 4:
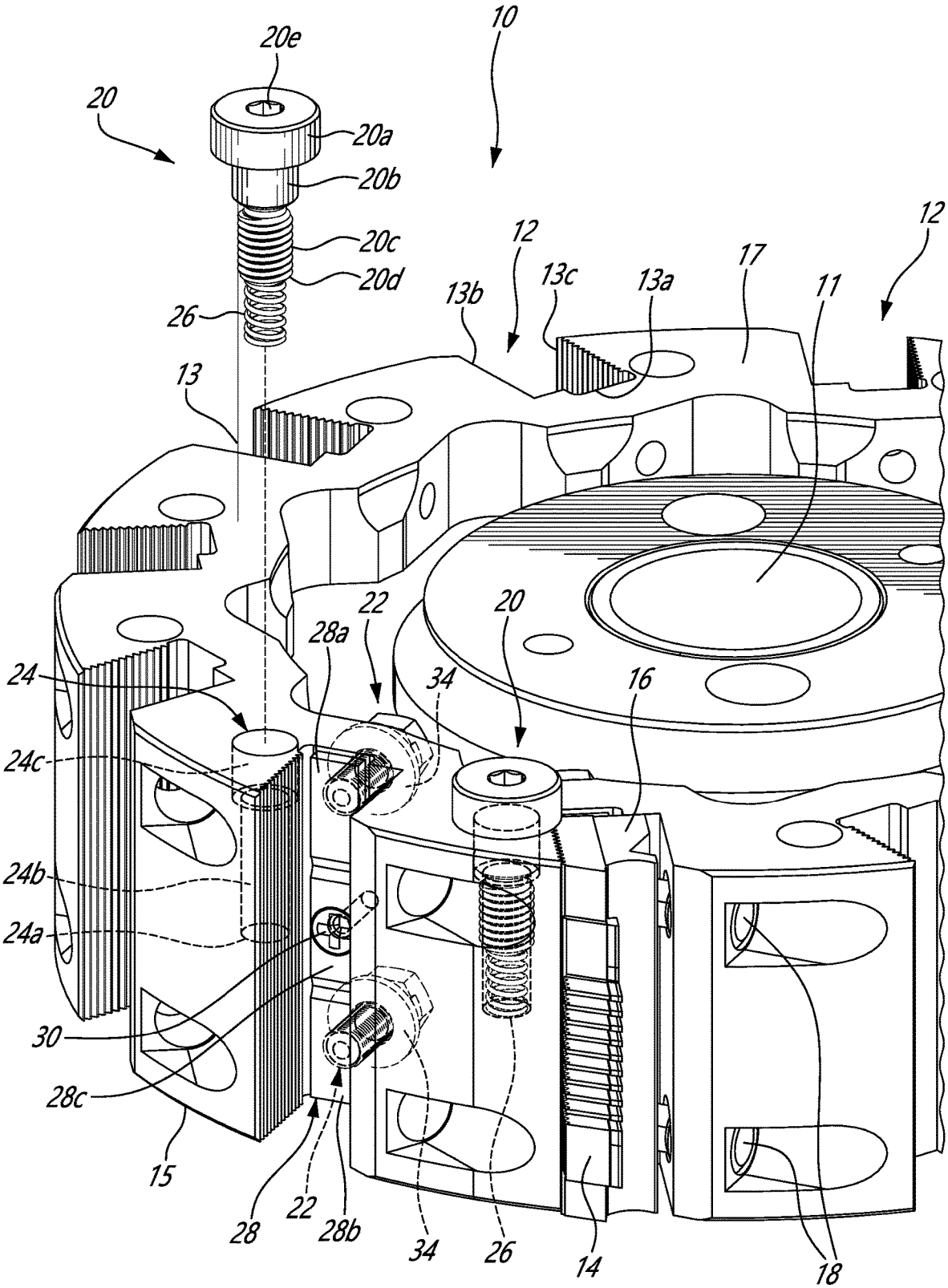
FIG. 4 is an enlarged 3D view of the cutterhead illustrating details of a spring loaded axial adjustment screw and of a pair of spring loaded radial and tangential adjustment screws of the adjustable knife insert positioning system.

As best shown in FIGS. 3 and 4, each knife holders 12 has an adjustable knife insert positioning system for axially, radially and tangentially micro-adjusting the position of the knife inserts 14 relative to one another. For finger jointing applications, the total indicator run-out (TIR) should typically be within 0.002". The adjustable knife insert positioning system is, thus, designed to provide that level of micro-adjustment. According to the illustrated embodiment, the positioning system includes three adjustable positioning surfaces for allowing axial, radial and tangential/angular positioning adjustment of each individual knife insert 14.

More specifically, the exemplified adjustable knife insert positioning system of each knife holder 12 comprises an axial adjustment screw 20 for adjusting an axial position of the knife insert 14 in the corresponding pocket 13 along an axis parallel to axis A, and a pair of radial and tangential adjustment screws 22 for adjusting both the radial position and the tangential position (the angle between the knife insert 14 and the bottom 13*a* of the pocket 13) of the knife insert 14 in the pocket 13.

As best shown in FIG. 4, each axial adjustment screw 20 is mounted in a corresponding screw receiving hole 24 defined in the body of the cutterhead 10 adjacent to the serrated wall 13*c* of an associated knife insert pocket 13. According to the illustrated embodiment, each axial adjustment screw 20 is provided in the form of a shoulder screw having a cylindrical head 20*a* and a shank extending from the cylindrical head 20*a*, the shank including an enlarged cylindrical smooth shoulder portion 20*b* followed by a threaded portion 20*c* ending in a flat abutting end 20*d*. An hexagonal socket 20*e* is defined in the cylindrical head 20*a* for engagement with a tool, such as an Allen Key or wrench. The screw receiving hole 24 in which the axial adjustment screw 20 is engaged is machined in one of the axially facing surfaces 15, 17 of the body of the cutterhead 10 (surface 17 in the illustrated embodiment). The screw receiving hole 24 has a bottom portion 24*a*, a threaded portion 24*b*, and an enlarged shoulder receiving portion 24*c*. The enlarged shoulder receiving portion 24*c* cooperates with the enlarged cylindrical smooth shoulder portion 20*b* of the screw 20 to precisely axially position the screw 20 relative to the body of the cutterhead 10. The threaded portion 24*b* of the hole 24 is configured for threading engagement with the threads of the threaded portion 20*c* of the screw 20. As shown in FIG. 4, a compression spring 26 is loaded in the bottom portion 24*a* of the screw receiving hole 24 to spring load the screw 20 in an axial direction away from the bottom of the screw receiving hole 24. The spring 26 extends between the flat distal end 20*d* of the screw 20 and the bottom wall of the screw receiving hole 24. The spring load is selected to prevent unintentional loosing of the screw and is set to provide a high load on the screw to provide restriction against the rotation of the screw, thereby helping to finely micro-adjust the position of the associated knife insert. As shown in FIGS. 3 and 4, the knife insert 14 is axially abutted at one axial end thereof against the undersurface of the cylindrical head 20*a* of the axial adjustment screw 20. The head 20*a* of the screw 20 is thus used to set the axial position of the knife insert 14 in the pocket 13. The undersurface of the head 20*a* of the screw 20 provides a dynamic reference plane (i.e. a positioning surface) that can be micro-adjusted by tightening or untightening the screw 20 for axially adjusting the position of one knife insert 14 relative to the other knife inserts 14 mounted to the cutterhead 10.

As shown in the drawings, each knife insert 14 is seated on a deformable plate 28 mounted in a recess defined in the bottom of each knife insert receiving pocket 13. As best shown in FIG. 4, the deformable plate 28 extends axially from a first end portion 28*a* to a second end portion 28*b*. The deformable plate 28 and the knife insert 14 are generally axially coextensive (i.e. they have about the same axial length). The deformable plate 28 has a central portion 28*c* intermediate the axial end portions 28*a*, 28*b*. The central portion 28*c* is securely attached to the body of the cutterhead 10 via suitable means, such as screw 30 or the like. Still referring to FIG. 4, it can be appreciated that a pair of radial and tangential adjustment screws 22 are mounted to the body underneath the opposed axial end portions 28*a*, 28*b* of each deformable plate 28. The attachment screw 30 is disposed axially mid-way between the two radial and tangential adjustment screws 22. The radial and tangential adjustment screws 22 are threadably engaged in respective threaded holes 32 (FIGS. 1 and 2) extending radially through the bottom of the recess in which the deformable plate 28 is mounted. The radial and tangential adjustment screws 22 are engaged in the corresponding threaded holes 32 from a radially inner facing surface of the body of the cutterhead 10. As best shown in FIG. 3, a lock washer 34 is provided between the head of each screw 22 and the radially inner facing mounting surface of the cutterhead body. The lock washers 34 spring load the radial and tangential adjustment screws 22 in a radially inward direction. The flat distal end of the radial and tangential adjustment screws 22 abuts the undersurface of the deformable plate 28. Accordingly, the radial and tangential adjustment screws 22 can be tightened to exert a radially outward pushing action on the opposed axial end portions 28*a*, 28*b* of the deformable plate 28, thereby causing the axially opposed end portions 28*a*, 28*b* to deform. The axially opposed end portions 28*a*, 28*b* of the deformable plate 28 thus provide two dynamic positioning surfaces for the knife insert 14. The adjustment screws 22 can be tighten to provide the same amount of deformation at the opposed axial ends 28*a*, 28*b* of the deformable plate 28, thereby providing for a radial adjustment of the position of a given knife insert 14 relative to the other knife inserts. However, if need be, one of the two adjustment screws 22 can be tighten to extend out of the threaded holes more than the other one, thereby causing the deformable plate 28 to deform more at one end portion than the other end portion. In this way, the angularity of knife insert 14 with respect to bottom 13*a* of the receiving pocket 13 can be adjusted so that one axial end of the knife insert 14 radially projects further from a circumference of the cutterhead 10 than the other axial end (the knife has an inclination from a first axial end to a second axial end). This is herein referred to has the tangential adjustment of the position of the knife inserts 14.

When deformed under the radially outward pushing action of the adjustment screws 22, the deformable plate 28 tends to elastically return to its rest position, thereby acting has a spring blade or leaf spring which contribute to further spring load the radial and tangential adjustment screws 22.

It can be appreciated that the cutterhead 10 provides a mechanical system for individually adjusting the knives. With the exemplified cutterhead 10, the user can micro-adjust each knife, radially, tangentially and axially to fit quality run-out requirements. This adjustment system allows end-users to receive fresh sharpened knives and replace them on the cutterhead with the simple help of a conventional optical comparator (not shown).

According to one aspect, the position of a knife insert 14 can be micro-adjusted via three points of support of the knife in its receiving pocket 13. Indeed, the three screws 20, 22 provide three dynamics positioning points/surfaces that enable the user to adjust the insert knives laterally, radially and tangentially.

According to another aspect, the knives set-up procedure can be sum-up as follows:

With the cutterhead 10 emptied of its knife inserts 14, loosen all the radial and tangential adjustment screws 22 and tighten all the axial adjustment screws 20. This may be done to set the nominal support points on all seats. Then, the technician can lightly tighten the clamping screws 18 for loosely clamping all knife inserts 14 in their respective receiving pockets 13. Using a conventional optical comparator, the operator can then locate the profile that is the closest to the axial adjustment screw in order to establish a nominal knife for the initial adjustment. For all other knife inserts 14, one by one, the operator can perform the following actions: 1) untighten the clamping screws 18, 2) use the axial adjustment screws 20 to set the new lateral position within a predetermined tolerance (e.g. 0.002") compared to the nominal knife insert, and 3) retighten the clamping screws 18.

Thereafter, the operator locates the lowest profile to establish a new nominal or reference knife. For all other knife inserts 14, one by one, the operator performs the following actions: 1) untighten the clamping screws 18, 2) use the radial and tangential adjustment screws 22 to set the new radial and tangential position within a predetermined tolerance (e.g. 0.002") compared to newly established nominal knife, and 3) retighten the clamping screws 18.

In this way, the end users can by themselves perform the required adjustment, thereby minimizing manufacturing downtime.

According to another aspect, there is provided a finger joint cutterhead equipped with a finger joint knife insert adjustment system including at least three adjustable positioning surfaces for allowing axial, radial and tangential adjustment of the knives relative to one another.

According to a further aspect, the adjustable positioning surfaces are adjustable via the operation of adjustment screws.

According to a still further aspect, each adjustment screw is spring loaded to provide a high restriction in rotation. This provides for an easy micro-positioning of the knife insert positioning/referencing surfaces. It also contributes to prevent the adjustment screws from moving once a new position has been established.

According to another aspect, a compression spring is used to spring load an axial adjustment screw. According to a further aspect, the axial adjustment screw is a shoulder screw.

According to a still further aspect, the knife insert is directly abutted on the head of the axial adjustment screw.

According to a still further aspect, the adjustment screws comprise a pair of radial and tangential adjustment screws which are configured to act on a steel plate positioned under the knife insert.

According to one aspect, the plate can be fixed to the body of the cutterhead in its center and the radial and tangential adjustment screws can be positioned to push on its opposed ends. Such an arrangement provides the liberty to the plate to slightly deform with a high restriction. Lock-washers or the like may be used to add more restriction on the radial and tangential adjustment screws. When tightening the radial and tangential screws, the knife radial and/or tangential position changes since the insert rests on both ends of the deformed steel plate.

The above description is meant to be exemplary only, and one skilled in the art will recognize that changes may be made to the embodiments described without departing from the scope of the invention disclosed. For instance, the number of dynamic supporting points and adjustment screws can vary depending on the level of adjustment needed. Also, the adjustment mechanism and associated method can be applied to other cutting equipment and are, thus, not strictly limited to the exemplified main application, i.e. the finger jointing application. Still other modifications which fall within the scope of the present invention will be apparent to those skilled in the art, in light of a review of this disclosure, and such modifications are intended to fall within the appended claims.

The invention claimed is:

1. A mechanism for adjusting the position of a finger joint knife in a pocket defined in a peripheral surface of a disc body of a rotary cutterhead mounted on a spindle for rotation about a central axis, the mechanism comprising: at least three dynamic knife supporting points adjustable relative to the disc body, the at least three dynamic knife supporting points including an adjustable axial referencing surface at one axial end of the pocket for axial abutment against an axial end surface of the finger joint knife, and a pair of adjustable radial referencing surfaces axially spaced apart along a radially inner bottom of the pocket, the adjustable radial referencing surfaces being individually adjustable relative to one another to provide for an angular adjustment of the finger joint knife relative to the central axis.

2. The mechanism defined in claim 1, wherein the at least three dynamic supporting points include an axial adjustment screw and a pair of radial and tangential adjustment screws mounted to the rotary cutterhead for acting on the finger joint knife.

3. The mechanism defined in claim 2, wherein the pair of adjustable radial referencing surfaces comprising a deformable plate fixedly attached at a central region thereof to the radially inner bottom of the pocket underneath the finger joint knife, the deformable plate extending axially between opposed axial ends of the finger joint knife, the pair of radial and tangential adjustment screws positioned to push on opposed axial end portions of the deformable plate in a radial direction away from the rotation axis of the rotary cutterhead.

4. The mechanism defined in claim 2, wherein the axial adjustment screw has a head, the head configured for axial abutment with the axial end surface of the finger joint knife.

5. The mechanism defined in claim 2, wherein the axial adjustment screw and the pair of radial and tangential adjustment screws are spring loaded.

6. The mechanism defined in claim 2, wherein the axial adjustment screw is a shoulder screw having an unthreaded enlarged shank portion slidably received in a corresponding unthreaded hole portion defined in the rotary cutterhead adjacent to the pocket.

7. The mechanism defined in claim 6, wherein a compression spring is acting against a distal end of the axial adjustment screw.

8. A rotary cutterhead comprising:

a body mounted for rotation about a central axis, the body defining a pocket in a circumferentially extending peripheral surface thereof, the pocket having opposed front and back walls extending from a radially inner bottom surface, the front and back walls spaced-apart in a circumferential direction around the body and extending axially between a first axial face to a second axial face of the body; a knife insert mounted inside the pocket;

a clamp for securely holding the knife insert against the back wall of the pocket;

an axial adjustment screw mounted in a corresponding screw receiving hole defined in one of the first and second axial face of the body adjacent to the pocket, the axial adjustment screw having a head axially engageable with an axial end of the knife insert; and a pair of radial and tangential adjustment screws projecting radially outwardly from the radially inner bottom surface of the pocket for adjusting a radially inner end of the knife insert, the pair of radial and tangential adjustment screws axially spaced-apart along the pocket.

9. The rotary cutterhead defined in claim 8, further comprising a deformable plate mounted to the radially inner bottom surface of the pocket, the knife insert seated on the deformable plate in the pocket, the pair of radial and tangential adjustment screws pushing in a radially outward direction against opposed axial end portions of the deformable plate.

10. The rotary cutterhead defined in claim 9, wherein the deformable plate is attached to the radially inner bottom surface of the pocket by a central fastener disposed axially between the pair of radial and tangential adjustment screws.

11. The rotary cutterhead defined in claim 8, wherein the axial adjustment screw and the pair of radial and tangential adjustment screws are spring loaded.

12. The rotary cutterhead defined in claim 8, wherein the axial adjustment screw is a shoulder screw having an unthreaded enlarged shank portion slidably received in a corresponding unthreaded hole portion defined in the body of the rotary cutterhead.

13. The rotary cutterhead defined in claim 12, wherein a compression spring is disposed in the receiving hole in axial abutment against a distal end of the axial adjustment screw.

14. The rotary cutterhead defined in claim 8, wherein the radial and tangential adjustment screws are threadably engaged in respective threaded holes extending radially through the radially inner bottom surface of the pocket, the radial and tangential adjustment screws engaged in the respective threaded holes from a radially inner facing surface of the body of the cutterhead.

15. The rotary cutterhead defined in claim 14, wherein a lock washer is provided between a head of each of the radial and tangential adjustment screws and the radially inner facing surface of the body of the cutterhead, the lock washers spring loading the radial and tangential adjustment screws in a radially inward direction.

16. A finger joint cutterhead comprising:

a disc body having a peripheral surface extending circumferentially around a central axis;

a pocket defined in the peripheral surface, the pocket having a front wall and a back wall spaced-apart in a circumferential direction and extending radially outwardly from a bottom wall and axially between opposed axial faces of the disc body;

a finger joint knife clampingly mounted in the pocket;

an axial knife reference surface adjustably mounted in an axial direction at one end of the pocket and configured for axial abutment with an adjacent axial end surface of the finger joint knife; and first and second radial knife reference surfaces axially spaced-apart along the bottom wall of the pocket, the first and second radial knife reference surfaces individually adjustable in a radial direction for radial adjustment of a corresponding radially inner surface of the finger joint knife.

17. The finger joint cutterhead defined in claim 16, wherein the axial knife reference surface is provided by an axial adjustment screw threadably engaged in a screw receiving hole defined in one of the opposed axial faces of the disc body at a location circumferentially adjacent to the pocket.

18. The finger joint cutterhead defined in claim 16, wherein the first and second radial knife reference surfaces includes a pair of radial adjustment screws threadably engaged in respective radial screw receiving holes extending through the bottom wall of the pocket, and a deformable plate lining the bottom wall of the pocket, the deformable plate having a central portion securely attached to the bottom wall, the radial adjustment screws pushing in a radially outward direction against opposed axial end portions of the deformable plate.

19. The finger joint cutterhead defined in claim 18, wherein the radial adjustment screws are spring loaded in a radially inward direction.

20. The finger joint cutterhead defined in claim 18, wherein the deformable plate is a spring leaf.

* * * * *